US005266417A

United States Patent [19]

Kubo et al.

[11] Patent Number: 5,266,417

[45] Date of Patent: Nov. 30, 1993

[54] LOW-TEMPERATURE SERVICE NICKEL PLATE WITH EXCELLENT WELD TOUGHNESS

[75] Inventors: Takahiro Kubo; Yoshifumi Nakano; Chiaki Shiga, all of Chiba; Osamu Tanigawa, Okayama, all of Japan

[73] Assignee: Kawasaki Steel Corporation, Kobe, Japan

[21] Appl. No.: 946,805

[22] Filed: Sep. 17, 1992

Related U.S. Application Data

[63] Continuation of Ser. No. 732,660, Jul. 19, 1991, abandoned.

[51] Int. Cl.[5] ..... C22C 38/00

[52] U.S. Cl. ..... 428/683; 420/94; 420/119; 420/127

[58] Field of Search ..... 428/683; 420/94, 119, 420/127

[56] References Cited

U.S. PATENT DOCUMENTS 3,970,447 7/1976 Lang ..... 420/119

FOREIGN PATENT DOCUMENTS 56-156716 12/1981 Japan .
63-128118 5/1988 Japan .
63-290246 11/1988 Japan .
2-194122 7/1990 Japan .
2167441 5/1986 United Kingdom .

*Primary Examiner*—Michael Lewis
*Assistant Examiner*—N. M. Nguyen
*Attorney, Agent, or Firm*—Dvorak and Traub

[57] ABSTRACT

There is provided a low-temperature service nickel steel plate with excellent weld toughness. This steel plate consists essentially of not less than 0.03% of C, 0.02 to 0.22% of Si, 0.05 to 0.47% of Mn, not more than 0.005% of P, not more than 0.005% of S, 7.5 to 12.0% of Ni, 0.01 to 0.10% of Al, and the remaining of Fe, where the following relations stand $3.5\% \leqq (8Si+9Mn) \leqq 5.1\%$ and $123C+(8Si+9Mn) \leqq 10.9\%$.

5 Claims, 4 Drawing Sheets

LOW-TEMPERATURE SERVICE NICKEL PLATE WITH EXCELLENT WELD TOUGHNESS

This application is a continuation of application Ser. No. 07/732,660 filed Jul. 19, 1991, now abandoned.

BACKGROUND OF THE INVENTION

1. Field of the Invention

The present invention relates to low-temperature service nickel steel plates, each with excellent weld toughness, and particularly to such steel plates for use in fabricating the bases and rooftops of a liquefied natural gas (LNG) container tanks, and, as well as those steel plates for use in building inboard tanks of liquefied natural gas container ships. Because these applications involve exposure to extra low temperatures below −160° C., weld toughness is of vital significance.

2. Description of the Related Art

To date, 9% Ni steel has been a typical category for the production of LNG tank fabricating steel plates. Particularly, of such steel plates, a thin type has heretofore usually been selected, reflecting the fact that both the base and rooftop do not undergo heavy stress. In such applications, where the steel plates are exposed to extra low temperatures below −160° C., high toughness especially at welds is required.

Generally, the respective regions which are thermally affected within each weld of a steel plate are classified into the following:

(a) A coarse grain region to undergo intensive heating at a temperature of approximately over 1200° C.

(b) A fine grain region to go through with heating over a range of approximately 1200° to 900° C.

(c) A dual phase region to incur heating over a range of approximately 900° to 700° C.

(d) A tempered region to suffer heating over a temperature range of approximately 700° to 450° C.

Of these regions which are thermally affected in the course of welding, the coarse grain region which experiences intensive heating, has so far been given various measures to maintain its toughness.

Of late, however, it was found that the dual phase region within a weld joint between two thin steel plates incurred some loss of toughness (dual phase embrittlement) induced by the formation of island martensite, thereby causing a problem. It was noted that the embrittlement due to dual phase was conspicuous with high Ni-content steel which is of more than 7.5 wt % Ni (hereinafter, the Ni-content is presented in percentage). The reason behind this was subsequently clarified by the inventor through a study which showed that the island martensite would readily be generated at a dual phase region post-heating cooling stage due to a difference in carbon grain dispersion between austenite and ferrite in the dual phase region.

In this regard, it is known that tempering is useful in dissolving the island martensite. With this in view, it is understood that where two thick steel plates are welded together in a large number of passes, the island martensite once generated is partly dissolved in a subsequent welding heat cycle (equivalent to tempering), with the apparent loss of dual phase regional toughness failing to take place. Regrettably, however, it was disclosed by the inventor, et al, that for a weld joint between each two thin steel plates each measuring a thickness of not more than 10 mm, the number of passes required is not more than three. The island martensite is left totally undissolved after a subsequent welding heat cycle, whereby the dual phase region undergoes an outstanding toughness loss, with an increase in brittleness.

Accordingly, the inventor, et al, proposed in Japanese Unexamined Patent Publication No. 63-290246 as a measure to overcome this problem, that Ti would be added as an essential element with Mo selectively added as an optional element, upon optimally decreasing the contents respectively of Si and Mn. Further studies thereafter undertaken by the inventor brought forth the finding that the method referred to in this proposal was useful to improve toughness of a heating-inflicted thermally affected dual phase region, but not useful with a heating-inflicted thermally influenced fine grain region, where the fine grain region would show a brittle fracture surface in the Charpy impact test carried out at −196° C., whereby it turned out that the toughness of said fine grain region rather reduced.

In addition to the above-described method, there are also available other techniques which are disclosed respectively in Japanese Unexamined Patent Publication No. 63-128118, Japanese Patent Publication No. 56-10966, and Japanese Unexamined Patent Publication No. 56-156716. These techniques were devised solely to improve low-temperature toughness of a base metal, and via a study, the inventor, et al, ascertained that they were not very useful for the prevention of a dual phase regional toughness loss and avoidance of embrittlement.

SUMMARY OF THE INVENTION

It is therefore an object of the present invention to advantageously solve the previously discussed problem through the use of a low-temperature service nickel steel plate with excellent toughness characteristic at weld, wherein superior low-temperature toughness is assured not only in the dual phase region, but also other regions subject to a thermal effect due to heating from welding at temperatures higher than those used heretofore. The plates so processed also meet, as necessary, the requirements for respective strengths (yield strength: more than 60 kgf/mm$^2$, tensile strength: 70 to 85 kgf/mm$^2$) called for in the ASTM Standards (A553, A844) and the JIS Standards (SL9 N60).

The object of the present invention referred to above is achievable by introducing each of the following embodiments enumerated in the paragraphs below:

(1) As a first embodiment, there is provided a low-temperature nickel steel plate with excellent weld toughness, consisting essentially of the following composition:

C: Not less than 0.03 wt %,
Si: 0.02 to 0.22 wt %,
Mn: 0.05 to 0.47 wt %,
P: not more than 0.005 wt %,
S: not more than 0.005 wt %,
Ni: 7.5 to 12.0 wt %,
Al: 0.01 to 0.10 wt %, and
balance: substantially Fe,
where the following relations stand;

$$3.5 \text{ wt } \% \leqq (8Si+9Mn) \leqq 5.1 \text{ wt } \% \text{ and}$$

$$123C+(8Si+9Mn) \leqq 10.9 \text{ wt } \%.$$

(2) As a second embodiment, there is provided a low-temperature service nickel steel plate with excellent weld toughness, consisting essentially of the following composition:

Si: 0.02 to 0.25 wt %,
Mn: 0.05 to 0.50 wt %,
P: not more than 0.005 wt %,
S: not more than 0.005 wt %,
Ni: 7.5 to 12.0 wt %,
Al: 0.01 to 0.10 wt %,
Nb: 0.005 to 0.03 wt %, and
balance: substantially Fe,
where the following relations stand;

$$2.8 \text{ wt } \% A \leqq (8Si+9Mn) \leqq 5.7 \text{ wt } \% \text{ and}$$

$$9.5 \text{ wt } \% \leqq 123C+(8Si+9Mn) \leqq 12.9 \text{ wt } \%.$$

(3) As a third embodiment, there is provided a low-temperature service nickel steel plate with excellent weld toughness, consisting essentially of the following composition:
Si: 0.02 to 0.25 wt %,
Mn: 0.05 to 0.50 wt %,
P: not more than 0.005 wt %,
S: not more than 0.005 wt %,
Ni: 7.5 to 12.0 wt %,
Al: 0.01 to 0.10 wt %,
Nb: 0.005 to 0.03 wt %,
V: 0.005 to 0.03 wt %, and
balance: substantially Fe,
where the following relations stand;

$$2.8 \text{ wt } \% A \leqq (8Si+9Mn) \leqq 5.7 \text{ wt } \% \text{ and}$$

$$9.5 \text{ wt } \% \leqq 123C+(8Si+9Mn) \leqq 12.9 \text{ wt } \%.$$

The present invention can readily provide a low-temperature service structural nickel steel plate with excellent low-temperature toughness, particularly superior toughness at the welds, each inclusive of the coarse grain, fine grain and dual phase regions, and further provide such physical properties enabling to reinforcement of mechanical strength.

The other objects of the present invention will be clarified by reference to the following description.

DETAILED DESCRIPTION OF THE INVENTION

Figure 1:
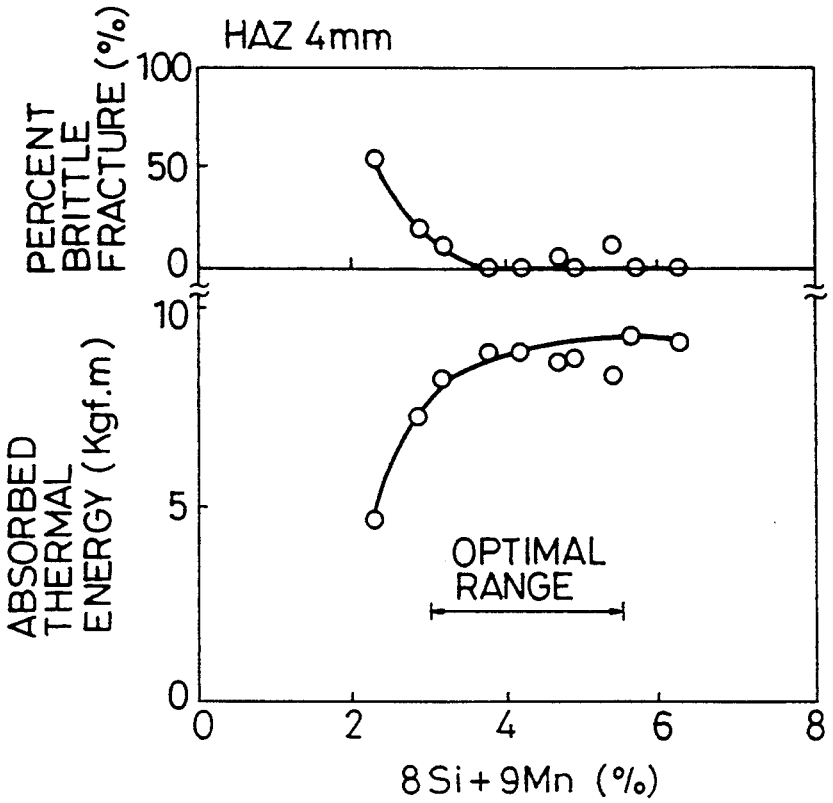
FIG. 1 is a graph showing the relation between the toughness at the position 4 mm off a weld fusion boundary (HAZ 4 mm) between two steel plates, each devoid of Nb, and having the content of 8Si+9Mn(%)

Each categorical steel according to the present invention has its chemical composition selected in the range specified above for content of elements, following the account given below.

Si is one of the characteristic elements involved in the present invention. This is because the compositional quantitative reduction of Si results in decreasing the volume of the island martensite generated in an area thermally affected due to heating from welding within the dual phase region. Si proves very useful in improving toughness in the dual phase region. To assure the toughness characteristic, it is required that where no Nb has been added, the content of Si be not more than 0.22%. If some Nb has been included, the content thereof must be not more than 0.25%. However, considering the past finding that selecting the content of Si in less than 0.02% regardless of how much is the content of added Nb, entails consideration of the deoxidation effect, and also the growing of the size of grains in the fine grain region which is subjected to heating at approximately 900° to 1200° C. from welding, and undergoing a subsequent thermal effect. Because the toughness at Si content less than 0.02% falls conspicuously, the lower limit of the Si-content was set at 0.02%.

Mn is also one of the characteristic elements included in the present invention, along with Si. Decreasing the Mn-content renders usefulness to decrease along with the decrease in Si-content, the volume of the island martensite generated in the dual phase region subjected to heating from welding and incurring of a subsequent thermal effect. With this in view, it is necessary that the Mn-content be not more than 0.47% in the case where no Nb has not been added and that the Mn content be not more than 0.50% for the case with Nb added. However, considering the fact that choosing the Mn-content of less than 0.05%, irrespective of the content of added Nb, not only fails in assuring the base metal of strength and toughness but also results in outstandingly reduced toughness at the fine grain region subjected to heating from welding and suffering a consequential thermal effect, the lower limit of the Mn-content was set at 0.05%.

For the present invention, in addition to the above-mentioned composition content limit settings, it is significant that each of the following relations must be met:

i) Case where no Nb is added:

$$3\% \leqq (8Si+9Mn) \leqq 5.5\%$$

ii) Case where Nb is added:

$$2.2\% \leqq (8Si+9Mn) \leqq 5.9\%$$

Even though it is required to suppress generation of the island martensite to improve the toughness characteristic by the present invention, decreasing contents of both Si and Mn is greatly effective in curbing island martensite generation. Further, it must be noted that there exists a strong correlation between the drop of toughness due to the growth of grains within the fine grain region to such a size of coarse grains, following heating thereat, and the total contents of Si and Mn.

Particularly, under the condition with the contents of Si and Mn selected such as to meet the relation of $(8Si+9Mn) \leqq 5.5\%$ for the case where no Nb has been added, and also the relation of $(8Si+9Mn) \leqq 5.9\%$ for the case in which Nb has been added, high toughness is achieved in the dual phase region subjected to heating from welding.

Further, under the condition with the contents of Si and Mn selected such as to meet the relation of $3\% \leqq (8Si+9Mn)$ for the case where no Nb has been added, and also the relation of $2.2\% \leqq (8Si+9Mn)$ for the case in which Nb has been added, high toughness is achieved in the fine grain region subjected to heating from welding.

The toughness at the welds was examined in submerged arc welding of a steel plate which is produced with such a basic chemical composition of P: 0.004%, S: 0.001%, Ni: 8 to 11%, and Al: 0.03% fixed while the C-, Si- and Mn-contents are variously changed over a range of $123C+(8Si+9Mn) \leqq 12\%$. The notches provided in a test piece steel plate prepared for the weld toughness proof test, and which are located at the positions 4 mm and 8 mm off the weld fusion boundary, correspond respectively to the fine grain and dual phase regions.

Figure 2:
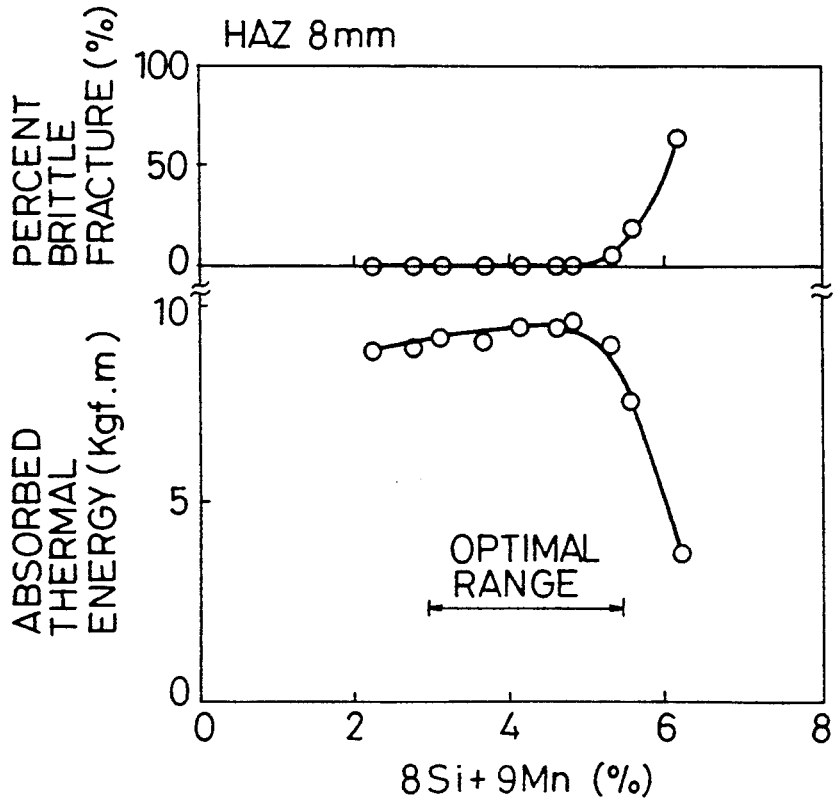
FIG. 2 is a graph showing the relation between the toughness at the position 8 mm off the weld fusion boundary (HAZ 8 mm) between two steel plates, each devoid of Nb, and having the content of 8Si+9Mn (%)

FIG. 1 shows the relation between the toughness at the point 4 mm off the fusion boundary and $(8Si+9Mn)$ while FIG. 2 shows the relation between the toughness at the position 8 mm off the fusion boundary and $(8Si+9Mn)$.

As is clear from the above figures, excellent low-temperature toughness is obtained at the respective positions 4 mm and 8 mm off the fusion boundary, namely within the fine grain and dual phase regions where the total contents of Si and Mn are within a range of $3\% \leqq (8Si+9Mn) \leqq 5.5\%$.

Also examined was the toughness at the welds from submerged arc welding of a steel plate which is produced with such a basic chemical composition of P: 0.004%, S: 0.001%, Ni: 8 to 11%, Al: 0.03%, and Nb: 0.005 to 0.03% fixed while the contents of C, Si and Mn are variously changed over a range of $123C+(8Si+9Mn) \leqq 13.5\%$.

Figure 3:
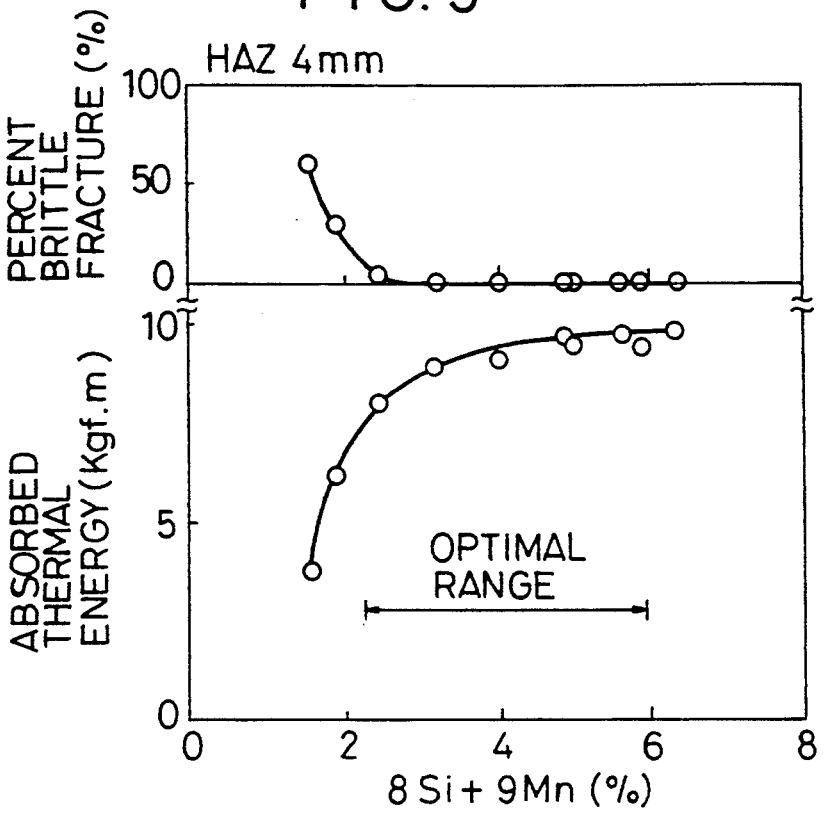
FIG. 3 is a graph showing the relation between the toughness at the position 4 mm off the weld fusion boundary (HAZ 4 mm) between two steel plates, each with Nb added, and having the content of 8Si+9Mn(%)
Figure 4:
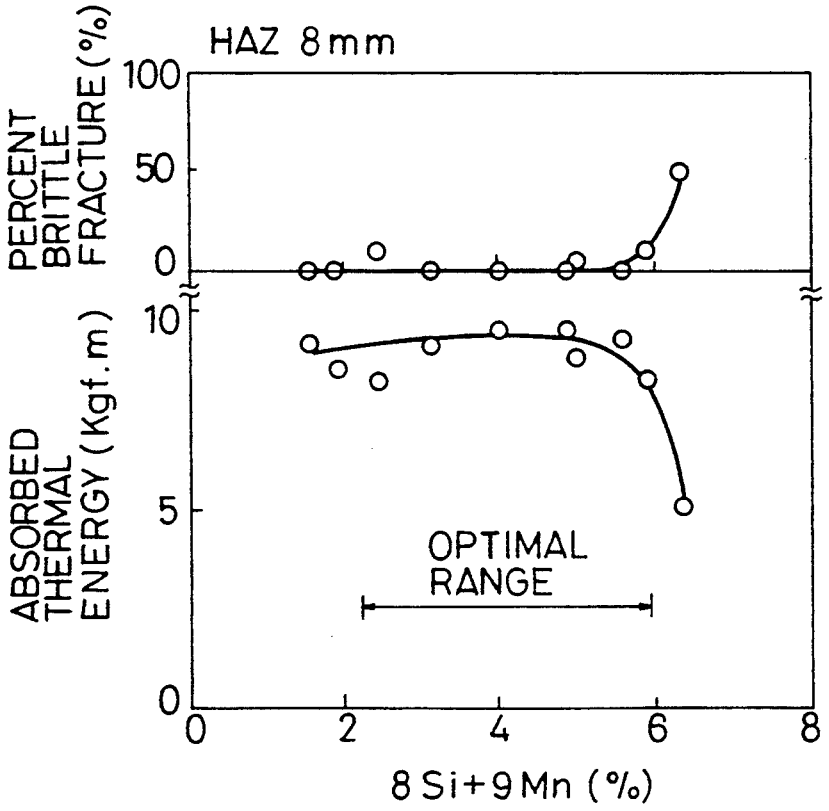
FIG. 4 is a graph showing the relation between the toughness at the position 8 mm off the weld fusion boundary (HAZ 8 mm) between two steel plates, each with Nb added, and having the content of 8Si+9Mn(%)

FIGS. 3 and 4, present the relationship between the toughness at the position 4 mm off the fusion boundary and $(8Si+9Mn)$ and the relationship between the toughness at the position 8 mm off the fusion boundary and $(8Si+9Mn)$. As is clear from these figures, superior low-temperature toughness is achieved both at the fine grain and dual phase regions where the total contents of Si and Mn are within a range of $2.2\% \leqq (8Si+9Mn) \leqq 5.9\%$.

Likewise with Si and Mn, C is another of the elements characteristic of the present invention. Decreasing the content of C, similarly to the respective cases of Si and Mn, coincides with reducing the volume of the island martensite within the dual phase region subjected to heating, whereby the toughness therein is improved. Also, in the fine grain region formed after heating, there is generated the island martensite, but decreasing the content of C in said fine grain region serves to suppress generation of the island martensite without increasing the size of grains up to the magnitude of coarse grains. The reduction in C-content is effective to improve the toughness within the fine grain region.

In other words, the content of C so selected as meeting the relation of $123C+(8Si+9Mn) \leqq 12\%$ for the case where no Nb has been added, and also the relation of $123C+(8Si+9Mn) \leqq 13.5\%$ for the case where Nb has been added, concurs with the achievement of high toughness within both the dual phase and fine grain regions. However, taking into account the finding that selecting the C-content at less than 0.03% for the case where no Nb has been added entails increasing the size of coarse grains, with the result that the toughness therein declines, the C-content of 0.03% is preferred. Further, C is a useful element to assure of sufficient mechanical strength. Excessive reduction of the C-content, as well as the Mn content must be avoided. Thus, to render the mechanical strength prescribed by the ASTM and JIS Standards, it is required not only to add Nb but also such select C-content as meets the relation of $9.5\% \leqq 123C+(8Si+9Mn)$.

Also examined was the toughness at the welds created through submerged arc welding of a steel plate which is produced with a basic chemical composition of P: 0.004%, S: 0.001%, Ni: 8 to 11%, and Al: 0.03% fixed while the contents of C, Si, and Mn are variously changed over a range of $3\% \leqq (8Si+9Mn) \leqq 5.5\%$. The notches provided in a test piece steel plate prepared for the weld toughness proof test and which are located at the positions 4 mm and 8 mm off the fusion boundary, correspond the fine grain and dual phase regions as in the foregoing.

Figure 5:
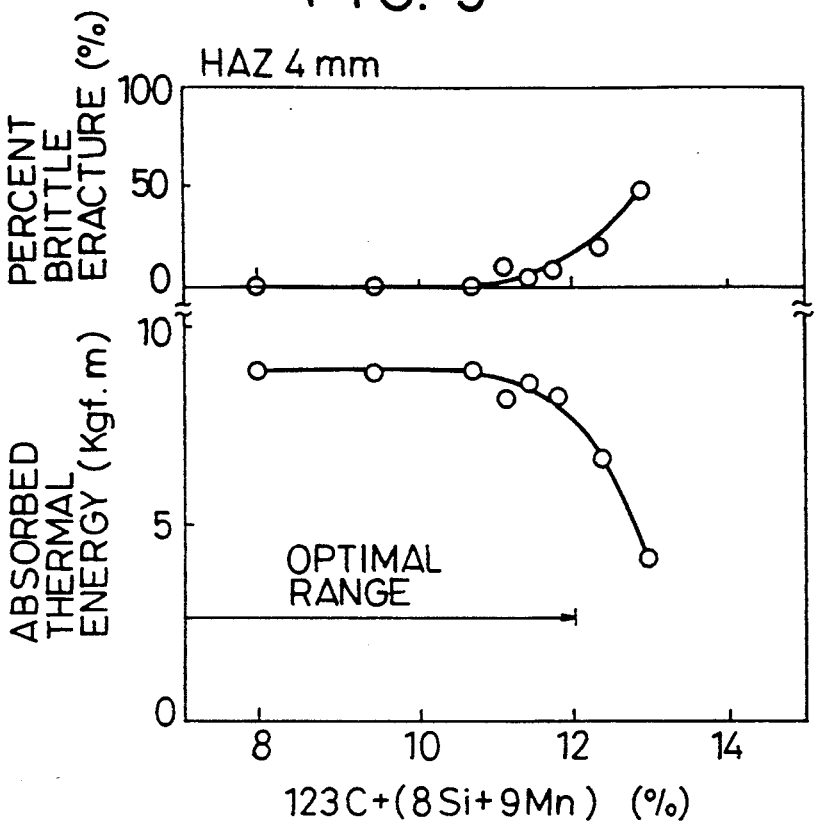
FIG. 5 is a graph showing the relation between the toughness at the position 4 mm off the weld fusion boundary (HAZ 4 mm) between two steel plates, each devoid of Nb, and having the content of 123C+(8Si+9Mn)(%)
Figure 6:
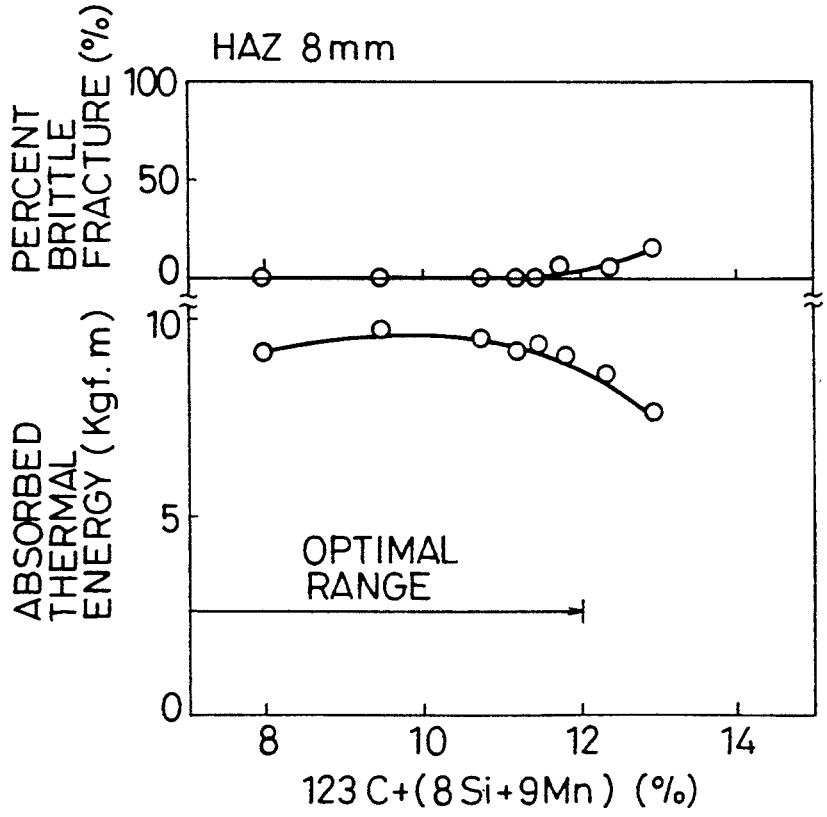
FIG. 6 is a graph showing the relation between the toughness at the position 8 mm off the weld fusion boundary (HAZ 8 mm) between two steel plates, each devoid of Nb, and having the content of 123C+(8Si+9Mn)(%)

FIG. 5 gives the relation between the toughness at the position 4 mm off the fusion boundary and $123C+(8Si+9Mn)$, and FIG. 6 the relation between the toughness at the position 8 mm off the fusion boundary and $123C+(8Si+9Mn)$.

As is clear from these figures, excellent toughness is obtained both within the fine grain and dual phase regions where the contents of C, Si and Mn are selected such as meet the relation of $123C+(8Si+9Mn) \leqq 12\%$.

Also examined was the toughness at the welds formed by submerged arc welding of a steel plate which is prepared with a basic chemical composition of P: 0.004%, S: 0.001%, Ni: 8 to 11%, Al: 0.03% and Nb: 0.005 to 0.03% fixed while the contents of C, Si, and Mn are variously changed over a range of $2.2\% \leqq (8Si+9Mn) \leqq 5.9\%$.

Figure 7:
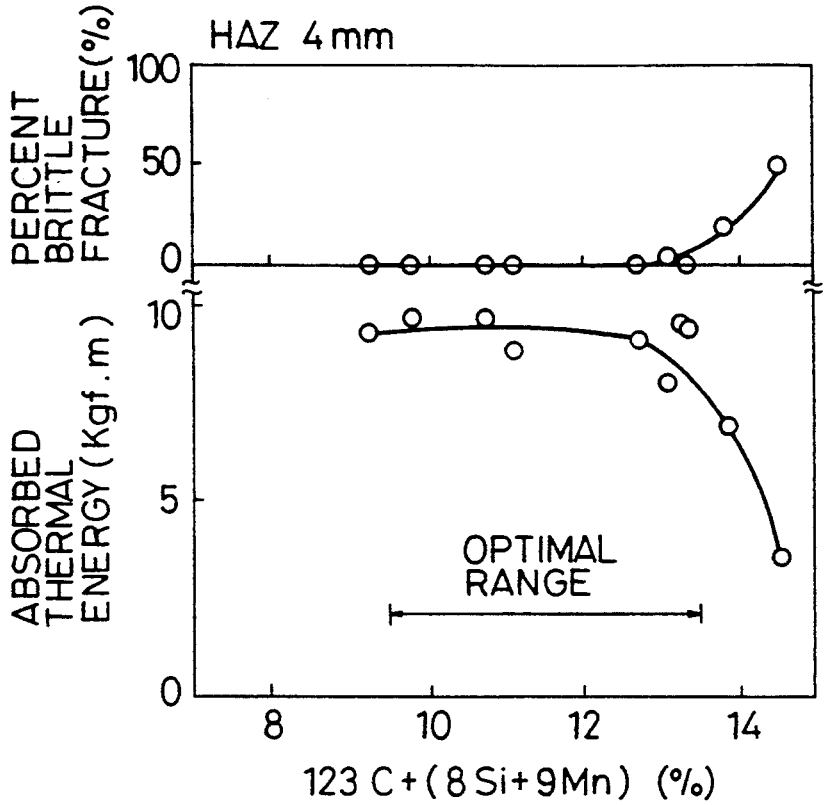
FIG. 7 is a graph showing the relation between the toughness at the position 4 mm off the weld fusion boundary (HAZ 4 mm) between two steel plates, each with Nb added, and having the content of 123C+(8Si+9Mn)(%)
Figure 8:
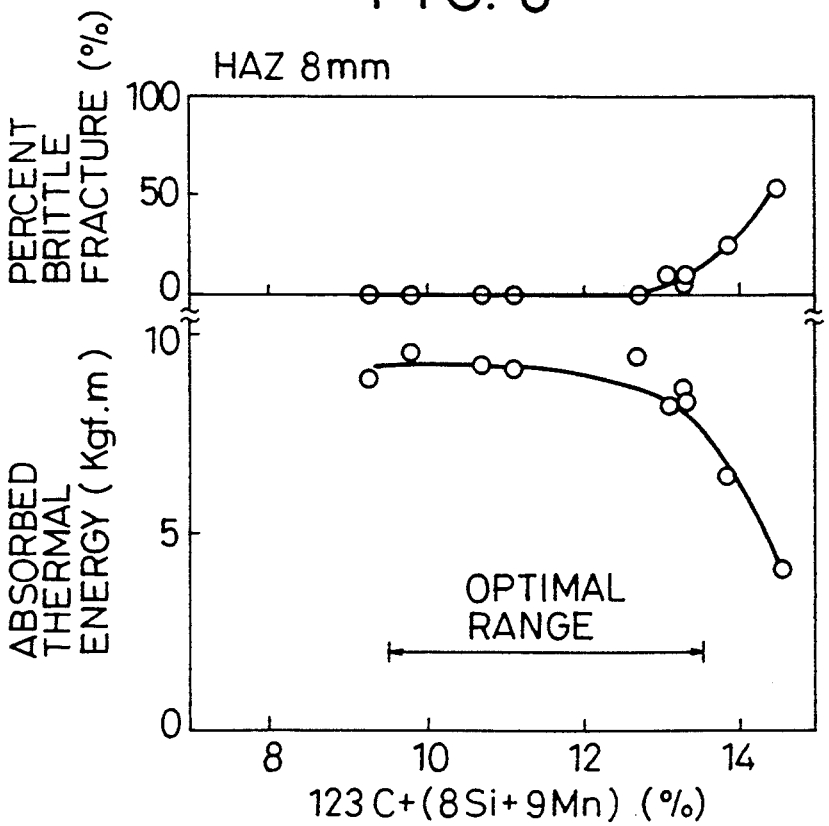
FIG. 8 is a graph showing the relation between the toughness at the point 8 mm off the weld fusion boundary (HAZ 8 mm) between two steel plates, each with Nb added, and having the content of 123C+(8Si+9Mn)(%).

FIGS. 7 and 8 present the relation between the toughness at the position 4 mm off the fusion boundary and $123C+(8Si+9Mn)$, and the relation between the toughness at the position 8 mm off the fusion boundary and $123C+(8Si+9Mn)$, respectively. As is clear from these figures, superior low-temperature toughness both within the fine grain and dual phase regions where the total contents of Si and Mn are selected such as meet the relation of $123C+(8Si+9Mn) \leqq 13.5\%$.

P is also one of the elements characteristic of the present element. Decreasing the content of P has a favorable effect on the improvement of the toughness at each of a base metal and welds, particularly the toughness within the dual phase region which has gone through heating from welding. It is accordingly desired to restrain mixing with P as far as possible, but the P-content of not more than 0.005% is permissible.

S also adversely affects the toughness respectively of a base metal and welds. With this taken into account, it is desired that the content of S be minimized at far as possible. However, the S-content of not more than 0.005% is permissible.

Though Ni is helpful to assure the low-temperature structural nickel steels having high toughness, the Ni content of less than 7.5% is not useful. Meanwhile, it is found that increasing the Ni-content beyond 12% fails to provide higher usefulness proportionally to its added quantity, but rather results in the saturation of usefulness, thus being uneconomical. Considering this, the Ni-content is limited to a range of 7.5 to 12.0%.

Al is an element essential for deoxidation. But the Al-content of less than 0.01% is not useful in this purpose. Raising the Al-content beyond 0.10% gives rise to the trouble of impairing its serviceability over purification. With this in view, the Al-content is limited to a range of 0.01 to 0.10%.

Nb is an element useful not only for improving the mechanical strength of both a base metal and welds via separating functional intensification, but also for improving the toughness of the entirety of a thermally affected area including the base metal and welds through lessening the size of grains.

Therefore, with a view toward maintaining high toughness at thermally affected welds, and assuring the mechanical strength as prescribed by the ASTM and JIS Standards, it is essential to add Nb. Considering that the Nb-content of less than 0.005% fails to carry serviceability for high toughness maintenance and prescribed mechanical strength assurance, and that increasing the Nb-content beyond 0.03% is neither useful to boost the mechanical strength, but rather results in impairing toughness, it is necessary to keep the Nb-content within a range of 0.005 to 0.03%.

V contributes to effectively improve the mechanical strength through separating functional intensification. With this in mind. It is allowed to add V to increase the mechanical strength. However, the V-content of less than 0.005% fails to improve mechanical strength. Meanwhile, increasing the V-content beyond 0.03% produces toughness impairment. Noting this, it is necessary to limit the V-content within a range of 0.005 to 0.03%.

Following the above chemical compositional content ranges specified for the individual elements concerned, any of the conventional known processes enumerated below for metal making is applicable. They comprise each post-rolling reheat quenching and tempering (RQ-T), post-rolling reheat quenching, dual phase region quenching and tempering (RQ-Q'-T), post-rolling direct quenching and tempering (DQ-T), and post-rolling direct quenching, dual phase region quenching and tempering (DQ-Q'-T), and so forth.

The following is the reason behind restricting the thickness of the nickel steel plate concerned to less than 10 mm:

With a plate thickness of below 10 mm, the number of passes in one welding cycle is small, and tempering by heating from welding cannot be done sufficiently. The result is that the island martensite fails to dissolve completely, and the toughness within the dual phase region undergoes a conspicuous fall with remarkable embrittlement.

In view of the above, the chemical compositional content ranges proposed by the present invention are especially useful with the steel plate of a thickness of not more than 10 mm.

Limiting the number of passes in one welding cycle to not more than 3 produces similar results. Where the number of passes in one welding cycle is not more than 3, the island martensite remains undissolved, causing the toughness within the dual phase region to experience intensive impairment along with increased embrittlement.

EXAMPLES

Example 1

Steel slabs comprising a variety of chemical compositions (each excluding Nb) shown in Table 1 were processed through hot rolling down to a thickness of 6 mm under a heating temperature of 1200° C. and a finish rolling temperature of 800° C. They were then cooled to a room temperature, and reheat quenched by 30-minutes of heating at 780° C. followed by water-cooling immediately thereafter, and then tempered for 45 minutes at 570° C. (RQ-T). Thereafter, each plate experienced submerged arc welding under the condition inclusive of a heat input of 20 kJ/cm, and 2 passes, with an austenitic steel wire applied. Subsequently, the base metal was examined for the mechanical strength and toughness, with each weld likewise undergoing a toughness examination. The consequences of the examination are presented in Table 2. The notches in each test piece prepared as in the foregoing for the weld toughness proof test were located at a bond area, a position 4 mm off the fusion boundary and another position 8 mm off the fusion boundary corresponding to the coarse grain, fine grain, and dual phase regions.

TABLE 1

(%)

| | No. | C | Si | Mn | P | S | Ni | Al | Note 1 | Note 2 |
|---|---|---|---|---|---|---|---|---|---|---|
| Steel | 1 | 0.053 | 0.12 | 0.36 | 0.005 | 0.001 | 9.15 | 0.025 | 4.20 | 10.72 |
| plates | 2 | 0.037 | 0.14 | 0.42 | 0.003 | 0.001 | 8.81 | 0.031 | 4.00 | 9.45 |
| of the | 3 | 0.065 | 0.17 | 0.20 | 0.005 | 0.002 | 9.08 | 0.033 | 3.16 | 11.16 |
| present | 4 | 0.052 | 0.19 | 0.43 | 0.004 | 0.001 | 10.24 | 0.027 | 5.39 | 11.79 |
| inven- | 5 | 0.034 | 0.20 | 0.24 | 0.004 | 0.001 | 9.53 | 0.028 | 3.76 | 7.94 |
| tion | 6 | 0.055 | 0.17 | 0.37 | 0.004 | 0.002 | 8.97 | 0.031 | 4.69 | 11.46 |
| Refer- | 7 | 0.052 | 0.14 | 0.13 | 0.004 | 0.002 | 9.46 | 0.041 | 2.29 | 8.69 |
| ence | 8 | 0.052 | 0.012 | 0.21 | 0.005 | 0.001 | 10.33 | 0.035 | 2.85 | 9.25 |
| steel | 9 | 0.037 | 0.20 | 0.45 | 0.004 | 0.001 | 11.28 | 0.027 | 5.65 | 10.20 |
| plates | 10 | 0.031 | 0.22 | 0.50 | 0.004 | 0.001 | 8.75 | 0.030 | 6.26 | 10.07 |
| for | 11 | 0.068 | 0.11 | 0.41 | 0.003 | 0.003 | 9.61 | 0.039 | 4.57 | 12.93 |
| compar- | 12 | 0.068 | 0.15 | 0.31 | 0.003 | 0.001 | 9.10 | 0.029 | 3.99 | 12.35 |
| ison | 13 | 0.048 | 0.23 | 0.28 | 0.004 | 0.002 | 8.94 | 0.043 | 4.36 | 10.26 |
| | 14 | 0.045 | 0.27 | 0.24 | 0.005 | 0.002 | 9.31 | 0.033 | 4.32 | 9.86 |
| | 15 | 0.037 | 0.08 | 0.48 | 0.003 | 0.001 | 10.09 | 0.029 | 4.96 | 9.51 |

TABLE 1-continued

| No. | C | Si | Mn | P | S | Ni | Al | Note 1 | (%) Note 2 |
|---|---|---|---|---|---|---|---|---|---|
| 16 | 0.039 | 0.10 | 0.51 | 0.004 | 0.001 | 9.61 | 0.038 | 5.39 | 10.19 |
| 17 | 0.029 | 0.16 | 0.32 | 0.004 | 0.002 | 9.31 | 0.035 | 4.10 | 7.60 |
| 18 | 0.021 | 0.17 | 0.38 | 0.005 | 0.002 | 9.06 | 0.028 | 4.78 | 7.36 |
| 19 | 0.051 | 0.13 | 0.34 | 0.007 | 0.001 | 9.09 | 0.027 | 4.10 | 10.37 |
| 20 | 0.048 | 0.24 | 0.65 | 0.003 | 0.001 | 9.15 | 0.028 | 7.77 | 13.67 |

Note 1: 8Si + 9Mn
Note 2: 123 C + (8Si + 9Mn)

TABLE 2

| | | Base metal's mechanical characteristics | | | Weld's toughness* | | |
|---|---|---|---|---|---|---|---|
| | | Mechanical strength | | | Notch locations | | |
| | No. | Yield strength (kgf/mm$^2$) | Tensile strength (kgf/mm$^2$) | Toughness* | Coarse grain region (Bond) | Fine grain region (HAZ 4 mm) | Dual phase region HAZ 8 mm) |
| Steel plates of the present invention | 1 | 64.7 | 68.6 | 9.6(0) | 6.2(0) | 8.9(0) | 9.5(0) |
| | 2 | 62.0 | 65.9 | 9.5(0) | 5.9(0) | 8.8(0) | 9.7(0) |
| | 3 | 65.4 | 68.8 | 9.5(0) | 6.3(0) | 8.2(10) | 9.2(0) |
| | 4 | 67.3 | 70.8 | 9.7(0) | 6.2(0) | 8.3(10) | 9.0(5) |
| | 5 | 61.2 | 64.2 | 9.4(0) | 5.8(0) | 8.9(0) | 9.1(0) |
| | 6 | 64.3 | 69.9 | 9.7(0) | 6.1(0) | 8.6(5) | 9.4(0) |
| Reference steel plates for comparison | 7 | 62.3 | 65.2 | 9.3(0) | 6.0(0) | 4.7(55) | 8.8(0) |
| | 8 | 64.4 | 66.5 | 9.4(0) | 5.9(0) | 7.3(20) | 8.9(0) |
| | 9 | 66.2 | 68.6 | 9.5(0) | 5.7(0) | 9.4(0) | 7.6(20) |
| | 10 | 62.4 | 66.4 | 9.5(0) | 5.6(0) | 9.2(0) | 3.8(65) |
| | 11 | 66.8 | 71.4 | 9.9(0) | 6.5(0) | 4.2(50) | 7.7(15) |
| | 12 | 67.2 | 71.8 | 9.8(0) | 6.4(0) | 6.7(20) | 8.6(5) |
| | 13 | 62.8 | 67.8 | 9.5(0) | 6.9(0) | 9.1(0) | 4.9(40) |
| | 14 | 63.8 | 67.7 | 9.4(0) | 5.9(0) | 8.8(0) | 3.5(65) |
| | 15 | 62.9 | 65.4 | 9.5(0) | 5.9(0) | 8.7(0) | 5.1(35) |
| | 16 | 65.0 | 68.6 | 9.6(0) | 6.0(0) | 9.0(0) | 3.7(65) |
| | 17 | 59.3 | 63.0 | 9.3(0) | 4.4(15) | 8.7(0) | 9.3(0) |
| | 18 | 59.5 | 62.7 | 9.3(0) | 3.0(20) | 8.6(0) | 8.9(0) |
| | 19 | 64.5 | 68.5 | 9.1(0) | 6.1(0) | 8.4(0) | 7.5(20) |
| | 20 | 68.2 | 73.5 | 9.8(0) | 6.6(0) | 3.8(65) | 2.7(75) |

*Each figure is of a quantity expressed in $\nu$E-196° C. (kgf-m).
The figure in the parentheses represents a percent brittle fracture (%).

As is clear from the above tables, the steel plates (Nos. 1 to 6), prepared in an optimal chemical compositional content range as prescribed in the present invention were found to show excellent toughness at welds.

Meanwhile, the steel plates numbered 7 and 8, each of which met the relation of $(8Si+9Mn)<3\%$, exhibited a remarkable loss of toughness at the position 4 mm off the fusion boundary. The steel plates numbered 9 and 10, each of which met the relation of $(8Si+9Mn)>5.5\%$, likewise displayed an outstanding loss in the toughness at the position 8 mm off the fusion boundary.

It is further noted that the steel plates (numbered 13 and 14), each with the Si-content exceeding 0.22%, and those (numbered 15 and 16), each with the Mn-content surpassing 0.47% displayed a conspicuous loss in the toughness at the position 8 mm off the fusion boundary. The whole of these steel plates were of such chemical compositions as to meet the relation of $3\% \leqq (8Si+9Mn) \leqq 5.5\%$ in respect of the Si- and Mn-contents.

Further, the steel plates numbered 11 and 12, each meeting the relation of $123C+(8Si+9Mn)>12\%$ displayed with an outstanding loss in the toughness at each of the positions 4 mm and 8 mm off the fusion boundary.

In addition, the steel plates numbered 17 and 18, each with the C-content of less than 0.03% and meeting the relation of $123C+(8Si+9Mn) \leqq 12\%$ displayed some loss in the toughness at the bond area. The steel plate numbered 19 with much P-content going beyond its upper limit displayed inferior toughness at the position 8 mm off the fusion boundary.

The steel plate numbered 20 of which chemical composition is disclosed in said Japanese Unexamined Patent Publication No. 63-128118 was likewise observed to possess a remarkable loss in the toughness at each of the respective positions 4 mm and 8 mm off the fusion boundary.

Example 2

Steel slabs comprising a variety of chemical compositions (each inclusive of Nb) shown in Table 3 underwent hot rolling down to a thickness of 6 mm under a heating temperature of 1200° C. and a finish rolling temperature of 800° C., then cooling to a room temperature, reheat quenching which comprised of 30-minute heating at 780° C. and water-cooling immediately thereafter, and 45 minute tempering at 570° C. (RQ-T). Thereafter, each plate was subjected to submerged arc welding under the condition inclusive of a heat input of 20 kJ/cm, and 2 passes, using an austenitic steel wire. Subsequently, the base metal was examined for mechanical strength and toughness, with each weld likewise undergoing a toughness examination. The outcome of the examination is presented in Table 4. The notches in each test piece prepared as in the foregoing for the weld toughness proof test, were located at a bond area, a position 4 mm off the fusion boundary and another position 8 mm off the fusion boundary, and corresponded to the coarse grain, fine grain and dual phase regions.

TABLE 3

| | No. | C | Si | Mn | P | S | Ni | Nb | V | Al | Note 1 | (%) Note 2 |
|---|---|---|---|---|---|---|---|---|---|---|---|---|
| Steel | 1 | 0.065 | 0.11 | 0.25 | 0.004 | 0.001 | 9.01 | 0.18 | — | 0.028 | 3.13 | 11.13 |
| plates | 2 | 0.071 | 0.23 | 0.24 | 0.003 | 0.002 | 10.36 | 0.027 | — | 0.031 | 4.00 | 12.73 |
| of the | 3 | 0.04 | 0.16 | 0.40 | 0.004 | 0.001 | 9.12 | 0.008 | — | 0.026 | 4.88 | 9.80 |
| present | 4 | 0.068 | 0.16 | 0.41 | 0.003 | 0.002 | 9.54 | 0.15 | — | 0.027 | 4.97 | 13.33 |
| inven- | 5 | 0.042 | 0.16 | 0.48 | 0.004 | 0.001 | 8.87 | 0.12 | — | 0.030 | 5.60 | 10.77 |
| tion | 6 | 0.061 | 0.24 | 0.44 | 0.005 | 0.001 | 8.23 | 0.010 | 0.010 | 0.025 | 5.88 | 13.38 |
| | 7 | 0.087 | 0.19 | 0.10 | 0.004 | 0.001 | 9.09 | 0.006 | 0.024 | 0.030 | 2.42 | 13.12 |
| Refer- | 8 | 0.070 | 0.08 | 0.10 | 0.003 | 0.002 | 8.62 | 0.015 | — | 0.032 | 1.54 | 10.15 |
| ence | 9 | 0.079 | 0.10 | 0.12 | 0.005 | 0.001 | 9.03 | 0.014 | — | 0.029 | 1.88 | 11.60 |
| steel | 10 | 0.044 | 0.24 | 0.49 | 0.003 | 0.002 | 9.14 | 0.020 | — | 0.031 | 6.33 | 11.74 |
| plates | 11 | 0.049 | 0.16 | 0.22 | 0.003 | 0.001 | 8.98 | 0.026 | — | 0.031 | 3.26 | 9.29 |
| for | 12 | 0.070 | 0.22 | 0.39 | 0.003 | 0.002 | 9.07 | 0.007 | — | 0.031 | 5.27 | 13.88 |
| compar- | 13 | 0.074 | 0.19 | 0.44 | 0.005 | 0.001 | 10.09 | 0.011 | — | 0.028 | 5.48 | 14.58 |
| ison | 14 | 0.058 | 0.27 | 0.25 | 0.005 | 0.001 | 8.76 | 0.012 | — | 0.027 | 4.41 | 11.54 |
| | 15 | 0.055 | 0.10 | 0.52 | 0.004 | 0.001 | 10.51 | 0.012 | — | 0.027 | 5.48 | 12.25 |
| | 16 | 0.056 | 0.15 | 0.28 | 0.003 | 0.002 | 9.83 | 0.033 | — | 0.026 | 3.72 | 10.61 |
| | 17 | 0.053 | 0.21 | 0.31 | 0.004 | 0.001 | 9.25 | 0.006 | 0.034 | 0.027 | 4.47 | 10.99 |
| | 18 | 0.069 | 0.23 | 0.25 | 0.007 | 0.001 | 9.52 | 0.025 | — | 0.028 | 4.09 | 12.58 |
| | 19 | 0.062 | 0.21 | 0.48 | 0.006 | 0.002 | 8.97 | 0.018 | — | 0.031 | 6.00 | 13.63 |
| | 20 | 0.053 | 0.16 | 0.54 | 0.006 | 0.007 | 9.05 | 0.025 | — | 0.028 | 6.14 | 12.66 |

Note 1: 8Si + 9Mn
Note 2: 123 C + (8Si + 9Mn)

TABLE 4

| | | Base metal's mechanical characteristics | | | Weld's toughness* | | |
|---|---|---|---|---|---|---|---|
| | | Mechanical strength | | | Notch locations | | |
| | No. | Yield strength (kgf/mm$^2$) | Tensile strength (kgf/mm$^2$) | Toughness* | Coarse grain region (Bond) | Fine grain region (HAZ 4 mm) | Dual phase region HAZ 8 mm) |
| Steel | 1 | 69.7 | 75.9 | 9.7(0) | 5.8(0) | 8.9(0) | 9.1(0) |
| plates | 2 | 75.2 | 80.4 | 9.6(0) | 5.3(0) | 9.1(0) | 9.5(0) |
| of the | 3 | 64.4 | 71.9 | 9.4(0) | 5.6(0) | 9.7(0) | 9.6(0) |
| present | 4 | 74.2 | 80.8 | 9.6(0) | 6.1(0) | 9.5(0) | 8.8(5) |
| inven- | 5 | 68.4 | 74.3 | 9.5(0) | 5.8(0) | 9.7(0) | 9.3(0) |
| tion | 6 | 75.3 | 82.0 | 9.9(0) | 6.2(0) | 9.4(0) | 8.3(10) |
| | 7 | 77.0 | 80.9 | 9.8(0) | 5.9(0) | 8.0(5) | 8.2(10) |
| Refer- | 8 | 66.2 | 72.9 | 9.3(0) | 5.8(0) | 3.8(60) | 9.2(0) |
| ence | 9 | 72.2 | 78.2 | 9.6(0) | 5.9(0) | 6.2(30) | 8.5(0) |
| steel | 10 | 71.9 | 78.0 | 9.8(0) | 6.0(0) | 9.8(0) | 5.1(50) |
| plates | 11 | 64.5 | 68.3 | 9.4(0) | 5.3(0) | 9.3(0) | 8.9(0) |
| for | 12 | 75.6 | 82.6 | 9.9(0) | 6.1(0) | 6.8(20) | 6.4(25) |
| compar- | 13 | 78.9 | 84.1 | 9.8(0) | 6.2(0) | 3.5(50) | 4.1(55) |
| ison | 14 | 73.1 | 78.8 | 9.8(0) | 6.0(0) | 9.6(0) | 4.8(35) |
| | 15 | 73.7 | 80.4 | 9.7(0) | 6.2(0) | 9.7(0) | 5.4(30) |
| | 16 | 72.3 | 75.1 | 7.8(10) | 4.9(10) | 7.1(15) | 7.7(10) |
| | 17 | 76.0 | 78.3 | 7.0(15) | 4.3(15) | 6.3(25) | 6.5(20) |
| | 18 | 77.7 | 83.0 | 9.1(0) | 5.1(0) | 8.8(0) | 7.5(15) |
| | 19 | 75.4 | 80.6 | 9.7(0) | 6.2(0) | 7.1(20) | 6.8(20) |
| | 20 | 67.9 | 71.6 | 9.4(0) | 6.0(0) | 9.7(0) | 4.6(40) |

*Each figure in the above table is of an quantity expressed in vE-196° C. (kgf-m).
The figure in the parentheses stands for a percent brittle fracture (%).

As is clear from the above tables, the steel plates (numbered 1 to 7), each prepared in an optimal chemical compositional content range as prescribed in the present invention had excellent toughness characteristics at welds.

Steel plates numbered 8 and 9, each meeting the relation of $(8Si+9Mn) \leqq 2.2\%$ showed a remarkable decline in toughness at the position 4 mm off the fusion boundary, and the steel plate numbered 10 meeting the relation of $(8Si+9Mn) > 5.9\%$ exhibited a conspicuous loss in toughness at the position 8 mm off the fusion boundary.

Commonly, the steel plate numbered 14 with the Si-content exceeding 0.25%, and the steel plate with the Mn-content surpassing 0.50%, displayed outstanding loss of toughness at the position 8 mm off the fusion boundary, nevertheless they meet the relation of $2.2\% \leqq (8Si+9Mn) \leqq 5.9$ with regard to their Si- and Mn-contents.

Further with the steel plates numbered 12 and 13 meeting the relation of $123C+(8Si+9Mn) \leqq 13.5\%$, it is observed that the toughness of the former at the position 4 mm off the fusion boundary, and the toughness of the latter at the position 8 mm off the fusion boundary both had experienced remarkable loss.

Further with the steel plate numbered 11 meeting the relation of $123C+(8Si+9Mn) < 9.5\%$, was not found to possess the mechanical strength prescribed by the ASTM and JIS Standards.

Steel plates numbered 16 and 17, the former with the Nb-content going beyond its upper limit, and the latter with the V-content likewise surpassing the upper limit, exhibited a decline in the toughness at the base metal and at the welds.

Steel plate numbered 19 with the P-content exceeding the upper limit, was tested for toughness at the position 8 mm off the fusion boundary. Toughness had undergone a reduction, resulting in being inferior.

Though the steel plates numbered 19 and 20 are found, each with the chemical composition disclosed in Japanese Patent Publication No. 56-10966, and Japanese Unexamined Patent Publication No. 56-1565716, the former displayed inferior toughness at the position 4 mm off the fusion boundary while the latter likewise showed such toughness at the position 8 mm off the fusion boundary which had suffered a substantial drop.

What is claimed is:

1. A low-temperature service nickel steel plate with excellent weld toughness, consisting essentially of the following composition:

C: not less than 0.03 wt %,
Si: 0.02 to 0.22 wt %,
Mn: 0.05 to 0.47 wt %,
P: not more than 0.005 wt %,
S: not more than 0.005 wt %,
Ni: 7.5 to 12.0 wt %,
Al: 0.01 to 0.10 wt %, and
balance: substantially Fe, where the following relations stand;

$$3.5 \text{ wt } \% \leqq (8Si+9Mn) \leqq 5.1 \text{ wt } \% \text{ and}$$

$$123C+(8Si+9Mn) \leqq 10.9 \text{ wt } \%,$$

wherein said steel plate has a thickness of not more than 10 mm, and each weld of said steel plate is prescribed to undergo not more than 3 passes for one welding cycle.

2. A low-temperature service nickel steel plate with excellent weld toughness, consisting essentially of the following composition:

Si: 0.02 to 0.25 wt %,
Mn: 0.05 to 0.50 wt %,
P: not more than 0.005 wt %,
S: not more than 0.005 wt %,
Ni: 7.5 to 12.0 wt %,
Al: 0.01 to 0.10 wt %,
Nb: 0.005 to 0.03 wt %, and
balance: substantially Fe, where the following relations stand;

$$2.8 \text{ wt } \% \leqq (8Si+9Mn) \leqq 5.7 \text{ wt } \% \text{ and}$$

$$9.5 \text{ wt } \% \leqq 123C+(8Si+9Mn) \leqq 12.9 \text{ wt } \%.$$

3. A low-temperature service nickel steel plate with excellent weld toughness, consisting essentially of the following composition:

Si: 0.02 to 0.25 wt %,
Mn: 0.05 to 0.50 wt %,
P: not more than 0.005 wt %,
S: not more than 0.005 wt %,
Ni: 7.5 to 12.0 wt %,
Al: 0.01 to 0.10 wt %,
Nb: 0.005 to 0.03 wt %, and
V: 0.005 to 0.03 wt %, and
balance: substantially Fe, where the following relations stand:

$$2.8 \text{ wt } \% \leqq (8Si+9Mn) \leqq 5.7 \text{ wt } \% \text{ and}$$

$$9.5 \text{ wt } \% \leqq 123C+(8Si+9Mn) \leqq 12.9 \text{ wt } \%.$$

4. A low-temperature service nickel steel plate with excellent weld toughness, consisting essentially of the following composition:

Si: 0.02 to 0.25 wt %,
Mn: 0.05 to 0.50 wt %,
P: not more than 0.005 wt %,
S: not more than 0.005 wt %,
Ni: 7.5 to 12.0 wt %,
Al: 0.01 to 0.10 wt %,
Nb: 0.005 to 0.03 wt %, and
V: 0.005 to 0.03 wt %, and
balance: substantially Fe, where the following relations stand:

$$2.8 \text{ wt } \% \leqq (8Si+9Mn) \leqq 5.7 \text{ wt } \% \text{ and}$$

$$9.5 \text{ wt } \% \leqq 123C+(8Si+9Mn) \leqq 12.9 \text{ wt } \%.$$

wherein said steel plate has a thickness of not more than 10 mm, and each weld of said steel plate is prescribed to undergo not more than 3 passes for one welding cycle.

5. A low-temperature service nickel steel plate with excellent weld toughness, consisting essentially of the following composition:

Si: 0.02 to 0.25 wt %,
Mn: 0.05 to 0.50 wt %,
P: not more than 0.005 wt %,
S: not more than 0.005 wt %,
Ni: 7.5 to 12.0 wt %,
Al: 0.01 to 0.10 wt %,
Nb: 0.005 to 0.03 wt %, and
balance: substantially Fe, where the following relations stand:

$$2.8 \text{ wt } \% \leqq (8Si+9Mn) \leqq 5.7 \text{ wt } \% \text{ and}$$

$$9.5 \text{ wt } \% \leqq 123C+(8Si+9Mn) \leqq 12.9 \text{ wt } \%.$$

wherein said steel plate has a thickness of not more than 10 mm, and each weld of said steel plate is prescribed to undergo not more than 3 passes for one welding cycle.

* * * * *